US011420211B2

(12) United States Patent
Sherman

(10) Patent No.: US 11,420,211 B2
(45) Date of Patent: Aug. 23, 2022

(54) MULTIPLE-STAGE GRINDING CIRCUIT

(71) Applicant: Fluor Technologies Corporation, Sugar Land, TX (US)

(72) Inventor: Mark Sherman, Highett (AU)

(73) Assignee: FLUOR TECHNOLOGIES CORPORATION, Irving, TX (US)

( * ) Notice: Subject to any disclaimer, the term of this patent is extended or adjusted under 35 U.S.C. 154(b) by 187 days.

(21) Appl. No.: 16/762,882

(22) PCT Filed: Dec. 29, 2017

(86) PCT No.: PCT/US2017/069032
§ 371 (c)(1),
(2) Date: May 8, 2020

(87) PCT Pub. No.: WO2020/068028
PCT Pub. Date: Apr. 2, 2020

(65) Prior Publication Data
US 2020/0261920 A1 Aug. 20, 2020

(51) Int. Cl.
*B02C 23/38* (2006.01)
*B02C 23/12* (2006.01)
(Continued)

(52) U.S. Cl.
CPC ..... *B02C 23/38* (2013.01); *B02C 23/12* (2013.01); *B02C 23/14* (2013.01); *B02C 23/22* (2013.01)

(58) Field of Classification Search
CPC ..... B02C 23/12; B02C 23/38; B02C 23/14; B03B 7/00
See application file for complete search history.

(56) References Cited

U.S. PATENT DOCUMENTS 2,675,966 A 6/1945 Kihlstedt
2,846,068 A * 8/1958 Smith ..... B03D 1/016 209/166
(Continued)

FOREIGN PATENT DOCUMENTS

GB 949792 2/1964
PE 000875-2020/DIN 6/2021
WO 2020068028 A1 4/2020

OTHER PUBLICATIONS

Opposition Writ dated Jul. 5, 2021, Chilean Patent Application No. 2020-1717 filed Dec. 29, 2017.
(Continued)

*Primary Examiner* — Faye Francis
(74) *Attorney, Agent, or Firm* — Conley Rose, PC

(57) ABSTRACT

A method includes separating, in a first stage of separating, crushed ore material by size into a first fines stream and a first coarse stream; grinding the first coarse stream in a second stage of grinding; feeding the product of the second stage of grinding back to the step of separating; feeding the first fines stream from the step of separating to a recovery circuit; producing a rejected stream from the recovery circuit of crushed ore material that does not meet the target mineral size; separating, in a second stage of separating, the rejected stream from the recovery circuit into a second fines stream and a second coarse stream; grinding the second coarse stream in a third stage of grinding; and feeding the product of the third stage of grinding back to the recovery circuit.

15 Claims, 4 Drawing Sheets

(51) Int. Cl.
*B02C 23/14* (2006.01)
*B02C 23/22* (2006.01)

(56) References Cited

U.S. PATENT DOCUMENTS 3,008,655 A * 11/1961 Adams ..... B03D 1/02 241/20
3,037,624 A * 6/1962 Jackson ..... B03D 1/001 209/2
3,145,163 A * 8/1964 Dancy ..... C01D 3/06 241/20
3,167,502 A * 1/1965 Duke ..... B03D 1/008 209/4
3,337,328 A * 8/1967 Lawver ..... B03B 9/00 75/10.67
3,417,927 A * 12/1968 Crocker ..... B02C 17/1805 241/24.1
3,677,475 A * 7/1972 Dancy ..... B03B 9/00 241/20
3,746,265 A * 7/1973 Dancy ..... B03B 7/00 241/20
3,750,963 A * 8/1973 Dancy ..... C01D 3/08 241/20
3,802,632 A * 4/1974 Dancy ..... B03B 7/00 241/20
4,070,274 A 1/1978 Bryson
4,189,103 A * 2/1980 Lawver ..... B03D 1/021 241/20
4,436,616 A * 3/1984 Dufour ..... B03B 9/00 209/166
5,007,587 A 4/1991 Evans et al.
5,007,589 A 4/1991 Evans et al.
2015/0360231 A1* 12/2015 Kessler ..... B03C 1/30 241/14

OTHER PUBLICATIONS

International Search Report and Written Opinion dated Mar. 7, 2018, International Application No. PCT/US2017/069032 filed Dec. 29, 2017.
International Preliminary Report on Patentability dated Jul. 9, 2020, International Application No. PCT/US2017/069032 filed Dec. 29, 2017.

* cited by examiner

MULTIPLE-STAGE GRINDING CIRCUIT

CROSS-REFERENCE TO RELATED APPLICATIONS

This application claims priority to and is the National Stage of International Application No. PCT/US2017/069032 entitled "Multiple-Stage Grinding Circuit" filed Dec. 29, 2017, by Mark Sherman, and is incorporated herein by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Milling may refer to the process of breaking down, separating, sizing, or classifying aggregate material. For example, milling may include rock crushing or grinding to produce a uniform aggregate size of the crushed material. In materials processing, a grinder or mill may be configured to produce fine particle size reduction through attrition and compressive forces at the grain size level.

SUMMARY

In an embodiment, a method for multiple-stage grinding may comprise providing a feed of crushed ore material; grinding the crushed ore material in a first stage of grinding; separating, in a first stage of separating, the crushed ore material by size into a first fines stream and a first coarse stream; grinding the first coarse stream in a second stage of grinding; feeding the product of the second stage of grinding back to the step of separating; feeding the first fines stream from the step of separating to a recovery circuit; recovering, by the recovery circuit, a target mineral size of the crushed ore material to produce a marketable product; producing a rejected stream from the recovery circuit of crushed ore material that does not meet the target mineral size; separating, in a second stage of separating, the rejected stream from the recovery circuit into a second fines stream and a second coarse stream; grinding the second coarse stream in a third stage of grinding; and feeding the product of the third stage of grinding back to the recovery circuit.

In an embodiment, a multiple-stage grinding circuit may comprise a first-stage grinding mill configured to receive crushed ore material, and complete a first stage of grinding the crushed ore material; a first separator configured to separate the crushed ore material into a first fines stream and a first coarse stream; a second-stage grinding mill configured to receive the first coarse stream, and complete a second stage of grinding the crushed ore material; a recovery circuit configured to receive the first fines stream, configured to recover a target mineral size of the crushed ore material, producing a marketable product, and to produce a rejected stream of material that does not meet the target mineral size; a second separator configured to receive the rejected stream from the recovery circuit and separate the crushed ore material into a second fines stream and a second coarse stream; and a third-stage grinding mill configured to receive the second coarse stream, and complete a third stage of grinding the crushed ore material, wherein the product of the third-stage grinding mill is fed back to the recovery circuit.

In an embodiment, a method for retrofitting a multiple-stage grinding circuit may comprise increasing the target mineral size for a second-stage grinding mill in a grinding circuit to produce a coarser product; separating, by a first separator, the product of the second-stage grinding mill into a first coarse stream and a first fines stream; feeding the first fines stream to a recovery circuit; adding a second separator to the grinding circuit configured to separate rejected material from the recovery circuit into a second coarse stream and a second fines stream; adding a third-stage grinding mill to the grinding circuit configured to receive the second coarse stream from the second separator; and feeding the product of the third-stage grinding mill to the recovery circuit.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
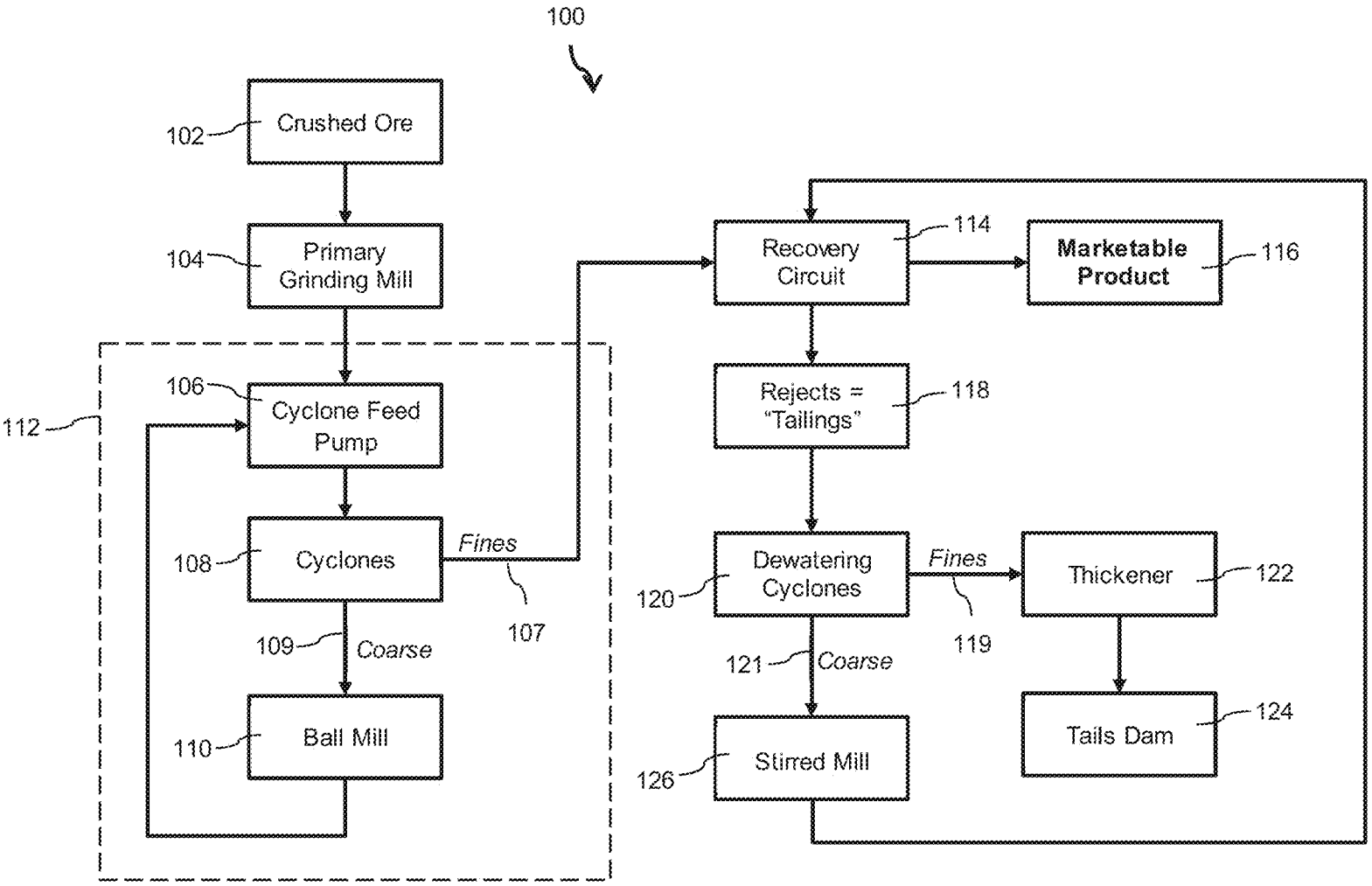
FIG. 1 illustrates an exemplary multiple-stage grinding circuit according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about" or "approximately" or the like, when used with a number, may mean that specific number, or alternatively, a range in proximity to the specific number, as understood by persons of skill in the art field; and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

Embodiments of the disclosure relate to systems and methods for multiple-stage grinding of crushed ore materials, improved grinding circuit efficiency, and increasing metal yield via selective grinding. Ores that contain metal typically require grinding down to particle sizes ranging from approximately 250 micrometers (microns) down to 100 microns or finer in size in order to free, or at least expose a portion of, the target mineral particles from the host rock. Once the target mineral(s) are exposed and or freed by the grinding process, the target mineral(s) can be recovered from the host rock. Typical grinding circuits may require high-cost capital equipment that consumes a lot of electrical power and consumes another high cost operating consumable in the form of grinding media (i.e., typically steel balls that tumble around inside the mill to grind up the ore). In addition to exposing the target minerals, grinding also impacts the metal recovery step in two ways via: 1) over-grinding some of the target minerals and 2) insufficient grinding of some of the ore. Over-grinding may reduce the efficacy of the recovery process by causing target minerals to end up as waste. Under-grinding of another portion of the ore may leave the target mineral locked inside the host rock and lost to the recovery step rejects stream.

Embodiments of the disclosure describe a modified grinding circuit configuration that may consume less electrical energy and less grinding media (i.e., the material used to grind the crush ore), and may yield more target mineral than a conventional grinding circuit by reducing the amount of target mineral that is over-ground and the amount that is insufficiently ground.

Typical mineral grinding circuits may use tumbling mills (e.g., Semi-Autogenous Grinding (SAG) mills, Autogenous Grinding (AG) mills, Rod mills and/or Ball mills) in conjunction with one or more cyclones (i.e., hydrocyclones) to grind the ore to a target grind size (e.g., 80% passing 150 micron) prior to a target mineral recovery step. However, due to the typical operation of the mills and cyclones in grinding circuits, some of the target mineral may be ground to sizes finer than 20 micron, causing lower recovery rates of the target mineral. Additionally, another portion of the cyclone product may be left as coarse as 400 micron, which also may cause a lower recovery rate due to the target mineral not being sufficiently exposed or freed from the host rock.

Embodiments of the disclosure may reduce the amount of mineral lost to both the over-ground and overly coarse (under-ground) size fractions of the crushed ore material, while also consuming less grinding power and grinding media (where power and media may represent approximately 60%-70% of the total grinding cost).

The proposed multiple-stage grinding process may also provide established (i.e., existing) operations with a (retrofit) method for increasing capacity without having to tie-in additional grinding mills into their original grinding circuit, which would require some major shutdowns, impact upon access to the existing plant during normal operation, and likely reduce construction efficiency. Installation of an additional grinding mill (e.g., a stirred mill) at the rear, or on the side of, an existing operation may potentially have less impact on the existing operation.

A typical mineral grinding circuit uses tumbling mills (i.e. SAG, AG, Rod and Ball mills) to grind the ore. Hydrocyclones are used to classify, i.e. separate the grinding mill product into two fractions: 1) the finished product, i.e. material that is fine enough to pass downstream to the metal recovery step and 2) material that is returned to the grinding mill because it is still too coarse to pass downstream. The target grind size product is typically described as an 80% Passing product size, e.g. 80% Passing (P80)=100 microns, where 80% indicated the $80^{th}$ percentile of the size distribution of the mineral material. However, due to the manner in which hydrocyclones operate in conjunction with the grinding mills, the ground product reporting to the downstream recovery process contains a broad range of size fractions, while maintaining the average $80^{th}$ percentile at the target. This large range includes the very fine product (over-ground) and the overly coarse product (under-ground), but because the target is determined by the $80^{th}$ percentile of the total size distribution, the target may be maintained even when the majority of the product is either under-ground or over-ground.

Referring now to FIG. 1, an exemplary flow diagram of a multiple-stage grinding process 100 is shown. The process 100 may comprise a source of crushed ore 102 feeding ore material to a primary grinding mill 104. The primary grinding mill 104 may complete a "first stage" grinding of the ore material. The product of the primary grinding mill 104 may be fed to a ball mill and cyclone circuit 112 comprising a cyclone feed pump 106 configured to feed the crushed ore to a first separator 108, which may comprise one or more cyclones (or hydrocyclones) 108. The cyclone(s) 108 may be configured to separate the crushed ore material, producing (at least one) first fines stream 107 and (at least one) first coarse stream 109. The first coarse stream 109 may be fed to a second-stage grinding mill 110 (e.g., ball mill 110), which may complete a "second stage" grinding of the ore material.

The multiple-stage grinding process 100 may comprise a ball mill 110 (which may be part of a typical grinding circuit) to produce a coarser product than what is typically produced by a ball mill in a typical grinding process. The targeting of a coarser grind size may allow for the use of a smaller ball mill 110, which may consume less power and grinding media, and may produce significantly less over-ground target mineral when compared with a ball mill tasked with producing a P80=150 micron or 100 micron product. For example, the target mineral size for the ball mill 110 may be approximately P80=300 micron.

The cyclone(s) 108 may comprise a typical classification hydrocyclone mounted at an angle ranging from the horizontal to the vertical. The first fines stream 107 from the cyclones 108 may be fed to a recovery circuit 114, where the recovery circuit 114 may separate out the marketable product 116 from the multiple-stage grinding process 100. In some embodiments, the marketable product 116 may comprise a target mineral size of P80=200 microns. The marketable product 116 may comprise a mineral size of P80=100 microns. In some embodiments, the marketable product 116 may comprise a target mineral size of P80=90 microns.

The tailings or rejects stream 118 (i.e. the waste) from the recovery circuit 114 (i.e., the mineral recovery step) may be diluted via the addition of water and separated using a second separator 120, e.g., dewatering cyclone(s) 120, to capture the excessively coarse material. In some embodiments, dilution may or may not be necessary. For example, flotation circuits may not require their rejects to be diluted, while gold cyanidation plant rejects would benefit from the addition of dilution water. The dewatering cyclone(s) 120 may comprise a different geometry when compared to the (hydro)cyclones 108 used in a typical grinding circuit (and used earlier in the grinding process 100). The dewatering cyclone(s) 120 may produce (at least one) second fines stream 119 and (at least one) second coarse stream 121. The second fines stream 119 (i.e., overflow stream) may be sent to a tailings thickener 122 configured to recover water for re-use and to collect the ground material for pumping to the tailings dam (or tailings dam) 124.

Because of the reduction in over-ground material from the ball mill 110, the solids content from the dewatering cyclones 120 and the second fines stream 119 may be lower than a typical grinding circuit, thereby changing the requirements for the thickener 122. As an example, the thickener 122 may require less flocculants (when compared to a typical thickener installation) in order to achieve the target settling rates. The use of dewatering cyclones 120 to classify the significantly more dilute stream than that classified by the first cyclones 108 results in the capture of the excessively coarse particles that would have otherwise passed through the recovery process and been lost to the tailings dam 124.

In the embodiment shown in FIG. 1, the dewatering cyclone underflow product (second coarse stream) 121, may be subjected to an additional stage of grinding (e.g., a third-stage grinding), using a third-stage grinding mill 126 (e.g., a stirred mill 126) to achieve a target grind size (e.g. P80=100 microns). Stirred mills may consume less power and grinding media than a ball mill, thereby reducing the cost of this grinding step. Stirred mills may also produce less over-ground product than a typical ball mill, which reduces the target minerals lost to the process rejects stream. The product from the stirred mill 126 being pumped back to the recovery circuit 114.

As an example, the crushed ore 102 fed to the primary grinding mill 104 may comprise 100% solids by weight (w/w), and then the primary grinding mill 104 may comprise approximately 70% solids w/w. The cyclone feed pump 106 (i.e., the material fed to the cyclones 108) may comprise between approximately 55% and 60% solids w/w. The ball mill 110 (and therefore the first coarse stream 109 from the cyclones 108) may comprise approximately 74% solids w/w. The recovery circuit 114 (and therefore the first fines stream 107 from the cyclones 108) may comprise approximately 30% to 42% solids w/w. Then, the marketable product 116 produced from the recovery circuit 114 may comprise approximately 94% to 100% solids w/w. The tailings stream 118 from the recovery circuit 114 (fed to the dewatering cyclones 120) may comprise approximately 28% to 42% solids w/w. The second fines stream 119 fed to the thickener 122 may comprise approximately 17% solids w/w, and the tailings dam 124 may comprise approximately 50% to 60% solids w/w. The stirred mill 126 (and therefore the second coarse stream 121 from the dewatering cyclones 120) may comprise approximately 55% solids w/w.

Given the low solids content of the dewatering cyclone (second) fines stream 119 (e.g. 17% solids w/w) when compared to typical mineral slurries presented to thickeners (e.g. 30%-50% solids w/w), the thickener 122 may require less flocculants when treating a dewatering cyclone product, where flocculants comprise chemicals used to promote the rapid settling out of fine solid particles from mineral slurries (and may be a high cost operating consumable). The improved thickener performance, combined with a reduction in the amount of over-ground (e.g., less-than-13 micron material) presented to the thickener 122 may also allow the use of a smaller thickener 122 when compared to that required to treat a typical tailings stream.

The use of dewatering cyclones 120 to classify the significantly more dilute stream, when compared to that classified by the cyclones 108 after the first stage of grinding, also results in more efficient capture of the excessively coarse particles that would have otherwise passed through the recovery process and been lost to the tailings dam 124.

The embodiments described herein of a new grinding circuit realize the aforementioned benefits by using a typical grinding circuit to produce a coarser product from the ball mill 110 stage of grinding (e.g. P80=approximately 300 microns), using a traditional ball mill and hydrocyclone circuit in a different way. The targeting of a coarser grind size allows the use of a smaller ball mill, which may cost less to install and may consume less power and grinding media. Additionally, the intentional pursuit of a more coarse product from the ball mill 110 (approx. P80=300 micron) may produce significantly less excessively fine target mineral when compared with a ball mill tasked with producing a P80=100 micron product.

The proposed multiple-stage grinding circuit may provide established operations with an alternative method for increasing capacity without having to tie-in additional grinding mills into their original grinding circuit (which may require major shutdowns, impact access to the existing plant during normal operation, and reduce construction efficiency). In some embodiments, the described multi-stage grinding circuit 100 may be accomplished by retrofitting an existing grinding circuit by adding (at least) the dewatering cyclones 120 and the stirred mill 126 (or third-stage grinding). Installation of a stirred mill 126 at the rear of, or on the side of, an existing operation may have less impact on the existing operation and can then be 'tied in' with the existing operation in a shorter time frame than a typical plant expansion (e.g. installation time for a stirred mill may range from 2-4 weeks, whereas the installation time for a ball mill may range from 12-16 weeks).

In some embodiments, it may be desired to increase the output of a grinding circuit while reducing the under-ground and over-ground material produced by the grinding circuit. As an example, an existing ball mill 110 in a circuit may typically operate at an 80% passing size of 100 micron (P80=100 micron). This ball mill 110 may be modified to a target grind size of greater than 100 micron, e.g., P80=300 micron. As an example, the ball mill 110 operating at P80=300 micron may be able to treat between approximately 30% and 100% more tonnage when the grind size has been increased from P80=100 micron. In some embodiments, the grinding media used within the ball mill 110 may also be changed, for example, by increasing the size of the steel balls that are used in the ball mill 110.

The tailings stream 118 would then be classified using the added dewatering cyclones 120 to capture the material coarser than 100 micron, which is then passed through the additional stage of grinding in the stirred mill 126. Then the output from the stirred mill 126 may be fed to an additional metal recovery step (at the recovery circuit 114) that may result in increased metal yields. In some embodiments, the retrofit method may also include making changes to the cyclones 108 and/or dewatering cyclones 120 based on the changes in the material that is being separated. The additional metal yields may not be achieved using the typical approach of adding additional power to the original grinding circuit (without the third-stage grinding) in order to achieve the same grind size at a 30% higher throughput rate.

Figure 2:
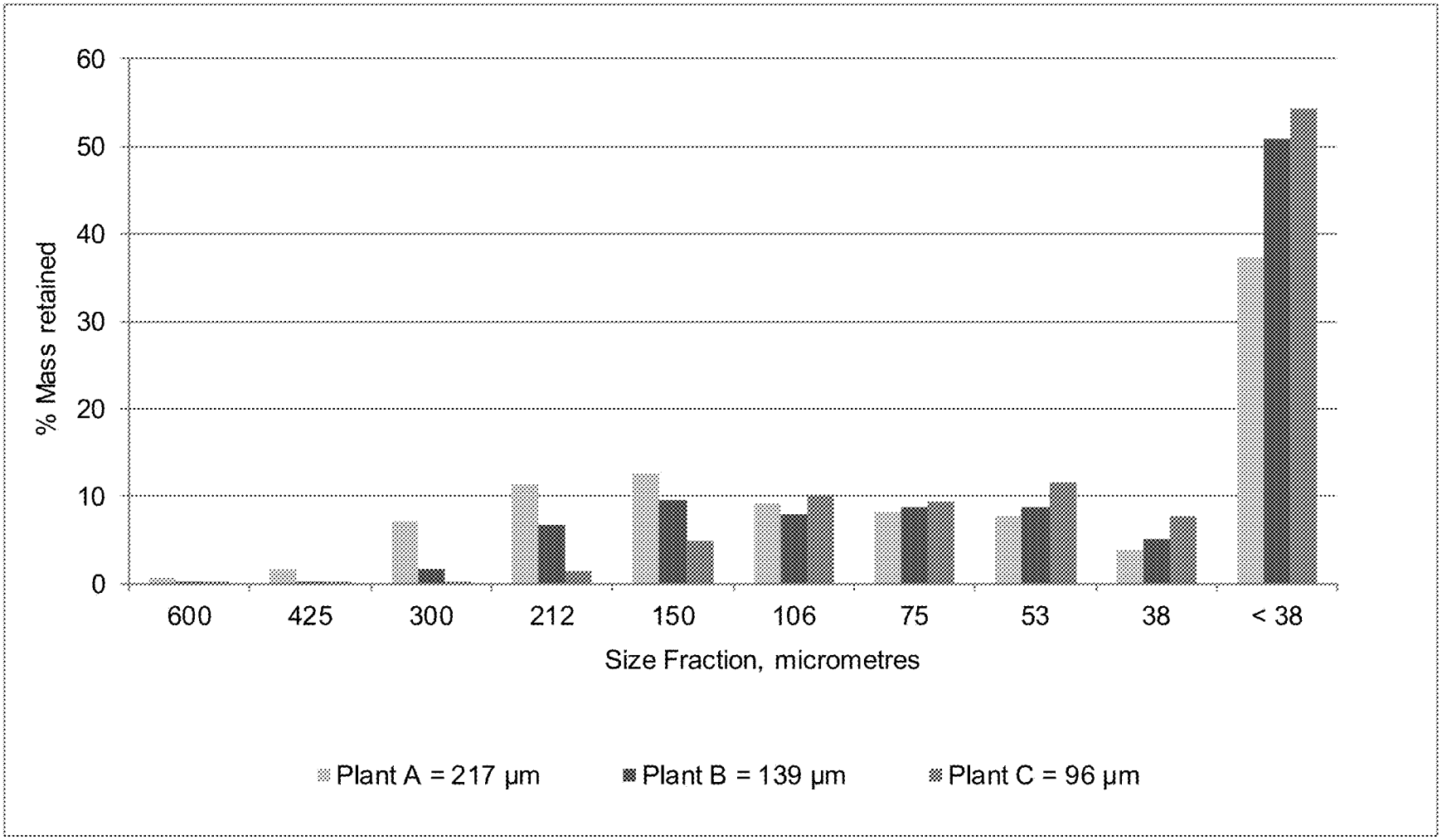
FIG. 2 illustrates a graphical representation of the size distribution of minerals within typical grinding circuits.

Referring now to FIG. 2, a graph of exemplary grinding circuit products is shown. These grinding circuits are represented by Plant A which has a target grinding size of P80=217 micron, Plant B which has a target grind size of P80=139 micron, and Plant C which has a target grind size of P80=96 micron. These plants may be located in different parts of the world and may be treating different mineral products. However, the graph of FIG. 2 illustrates that these average targets, which are determined by the $80^{th}$ percentile of the mineral size distribution, may be skewed due to the large amount of very fine material, i.e., less than 38 micron material. In other words, at these three plants, the target mineral size was not accomplished by minimizing the coarse material size, nor by maximizing the actual target mineral size (i.e., 217 micron, 139 micron, and 96 micron), but it is accomplished by skewing the total size distribution by the generation of over-ground material less than 38 microns in size.

As shown by the graph, in Plant A, approximately 38% of the produced material was less than 38 microns in size. In Plant B, approximately 51% of the produced material was less than 38 microns in size. In Plant C, approximately 55% of the produced material was less than 38 microns in size. The information shown in FIG. 2 illustrates the need for an improved multiple-stage grinding circuit configured to reduce the amount of material that is over-ground (i.e., the material less than 38 microns in size), thereby increasing the usable material that is produced by the grinding circuit.

As shown in FIG. 2, the mass % reporting to a size fraction is the mass fraction of the feed, expressed as a percentage that is retained on a screen whose aperture is given by the size, in micrometers. For example, approximately 10% of the grinding circuit's product passed through a 212 micron screen but was retained on a 150 micron screen. A similar mass passed through the 150 micron screen and was retained on a screen with a 106 micron aperture. The size fraction that shows the greatest amount of variability is the less-than-38 micron size fraction. This indicates that the technology currently used in the minerals grinding industry, i.e. the ball mill working with hydrocyclones, isn't particularly effective at reducing the coarse size minerals, and produces a finer P80 value by producing a lot more less-than-38 micron material.

The graph of FIG. 2 does not show the distribution of material in sizes less than 38 microns, as the sizing material using laboratory screens reaches its practical limit at the 38 micron screen size. To determine the sizes of the material finer than 38 microns may require specialty laboratory equipment.

Figure 3:
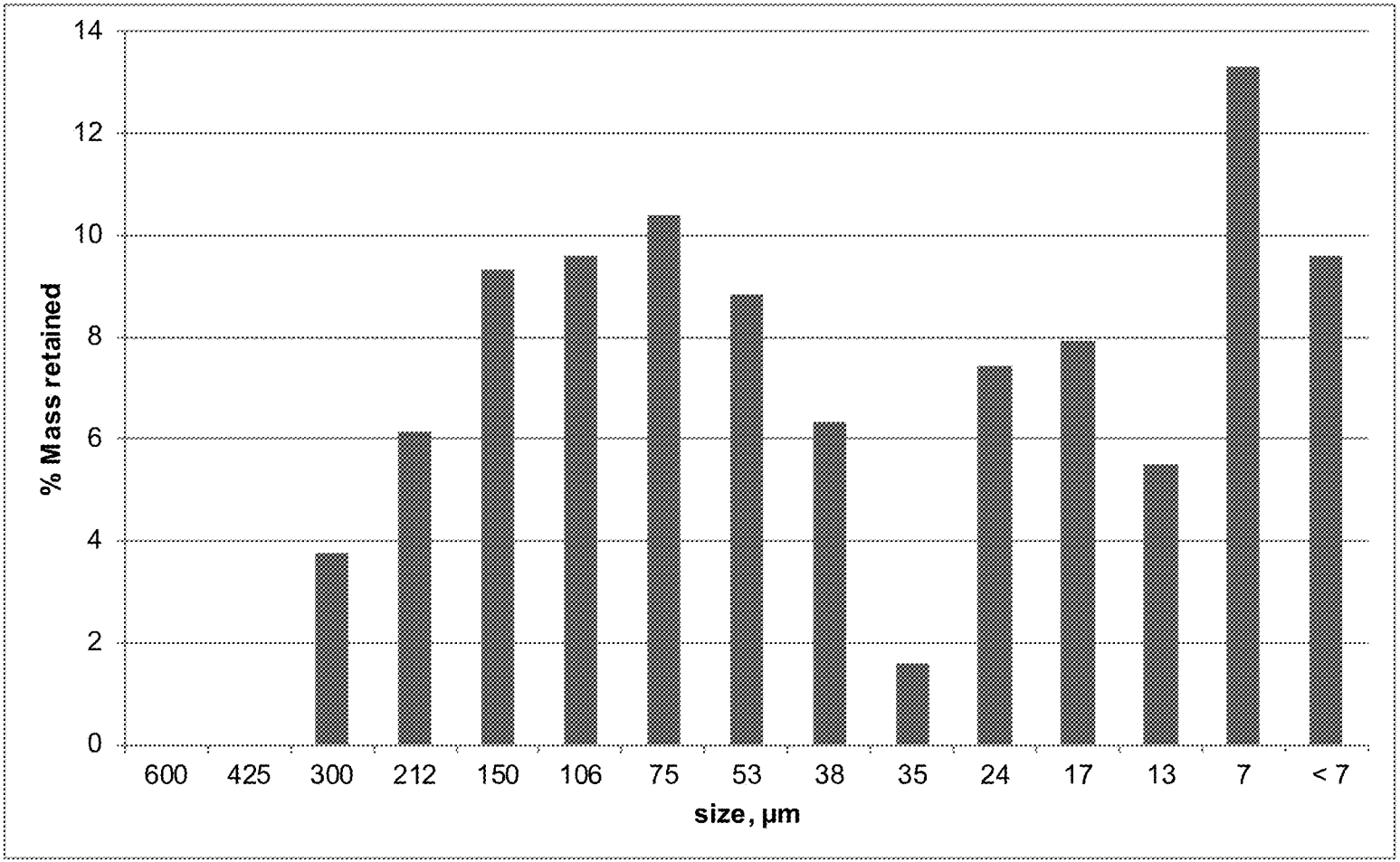
FIG. 3 illustrates another graphical representation of the size distribution of minerals within a typical grinding circuit.

FIG. 3 illustrates an example of the size distribution of a grinding circuit product from a large copper and gold flotation concentrator, with a target mineral size of P80=150 microns, where the number of size fractions increased to demonstrate the mass of very fine particles generated in the grinding circuit, e.g. particles as fine as 7 microns. Similar to the distribution shown in FIG. 2, the total material that is less than 38 microns (i.e., 35 microns and smaller) makes up approximately 45% of the total material. Additionally, approximately half of the material that falls into the less-than-38 micron size fraction is finer than 13 microns, illustrating the "over-ground" material referred to in this disclosure.

Figure 4:
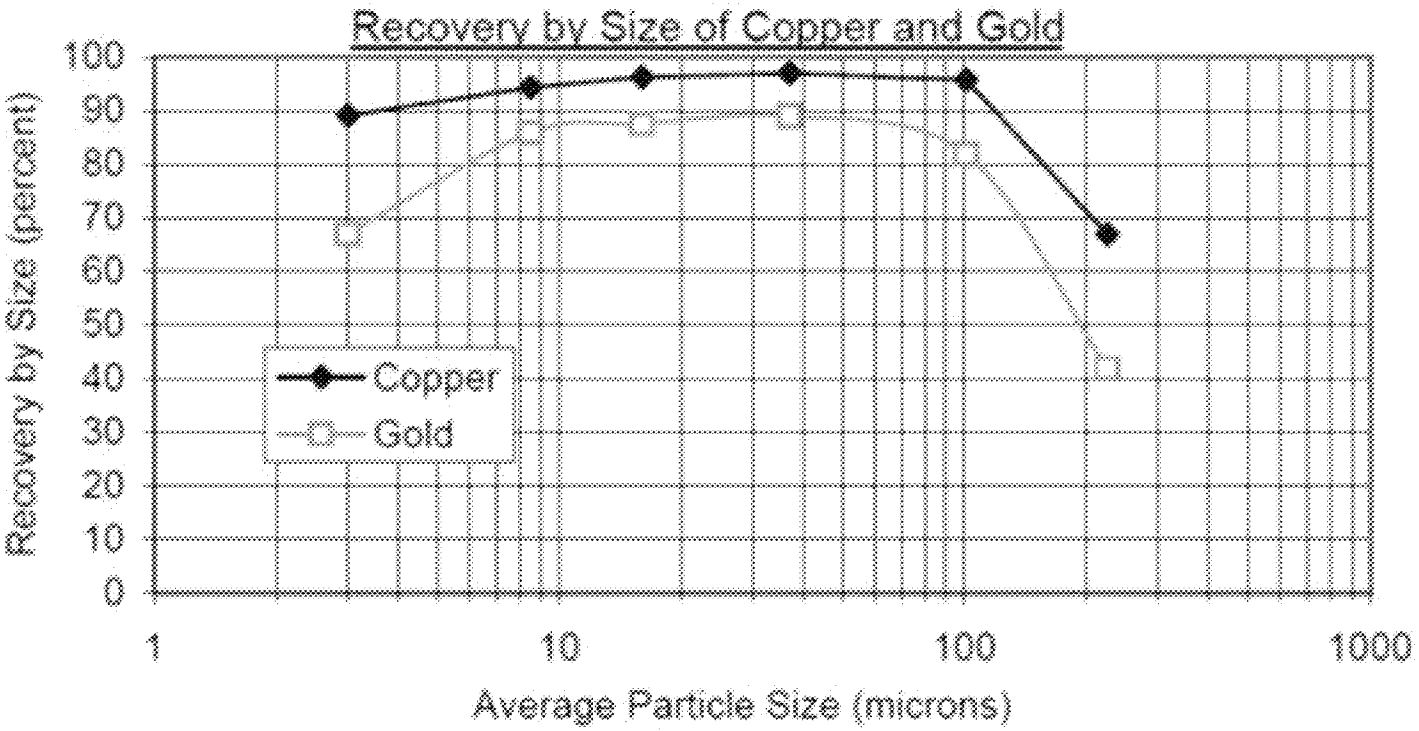
FIG. 4 illustrates a graphical representation of particle size distribution related to the recovery of copper and gold.

FIG. 4 illustrates the particle size distribution related to the recovery of copper and gold. As can be seen in the graph of FIG. 4, copper recovery decreases markedly (from approximately 95% to approximately 70% recovery) for particles larger than approximately 100 microns and also decreases (from approximately 95% to approximately 90% recovery) for copper particles less than approximately 30 to 40 microns. Similarly, gold recovery drops off markedly (from approximately 85% to approximately 45% recovery) for particles larger than approximately 100 microns and also decreases (from approximately 90% to approximately 65% recovery) for gold particles less than approximately 30 to 40 microns. By reducing the amount of both the excessively coarse (larger than 100 microns) and the over-ground (less than 30 microns) size fractions presented to the flotation circuit, copper and gold recoveries will improve.

Having described various devices and methods herein, exemplary embodiments or aspects can include, but are not limited to:

In a first embodiment, a method for multiple-stage grinding may comprise providing a feed of crushed ore material; grinding the crushed ore material in a first stage of grinding; separating, in a first stage of separating, the crushed ore material by size into a first fines stream and a first coarse stream; grinding the first coarse stream in a second stage of grinding; feeding the product of the second stage of grinding back to the step of separating; feeding the first fines stream from the step of separating to a recovery circuit; recovering, by the recovery circuit, a target mineral size of the crushed ore material to produce a marketable product; producing a rejected stream from the recovery circuit of crushed ore material that does not meet the target mineral size; separating, in a second stage of separating, the rejected stream from the recovery circuit into a second fines stream and a second coarse stream; grinding the second coarse stream in a third stage of grinding; and feeding the product of the third stage of grinding back to the recovery circuit.

A second embodiment can include the method of the first embodiment, further comprising diluting the rejected stream from the recovery circuit with water.

A third embodiment can include the method of the second embodiment, further comprising removing water from the crushed ore material from the recovery circuit using one or more dewatering cyclones.

A fourth embodiment can include the method of the third embodiment, wherein the second stage of separating is completed by the one or more dewatering cyclones.

A fifth embodiment can include the method of any of the first through fourth embodiments, further comprising recovering the same material from the second stage of grinding, via the recovery circuit, and the third stage of grinding, via the recovery circuit, to produce the marketable product.

A sixth embodiment can include the method of any of the first through fifth embodiments, wherein the target mineral size for the second stage of grinding is larger than the target mineral size for the third stage of grinding.

A seventh embodiment can include the method of the sixth embodiment, wherein grinding the coarse stream in a second stage of grinding comprises grinding to a target mineral size of approximately 80% passing 300 microns.

An eighth embodiment can include the method of the sixth or seventh embodiments, wherein grinding the coarse stream in a third stage of grinding comprises grinding to a target mineral size of approximately 80% passing 100 microns.

A ninth embodiment can include the method of any of the first through eighth embodiments, wherein the second stage of grinding is completed using a ball mill.

A tenth embodiment can include the method of any of the first through ninth embodiments, wherein the third stage of grinding is completed using a stirred mill.

In an eleventh embodiment, a multiple-stage grinding circuit may comprise a first-stage grinding mill configured to receive crushed ore material, and complete a first stage of grinding the crushed ore material; a first separator configured to separate the crushed ore material into a first fines stream and a first coarse stream; a second-stage grinding mill configured to receive the first coarse stream, and complete a second stage of grinding the crushed ore material; a recovery circuit configured to receive the first fines stream, configured to recover a target mineral size of the crushed ore material, producing a marketable product, and to produce a rejected stream of material that does not meet the target mineral size; a second separator configured to receive the rejected stream from the recovery circuit and separate the crushed ore material into a second fines stream and a second coarse stream; and a third-stage grinding mill configured to receive the second coarse stream, and complete a third stage of grinding the crushed ore material, wherein the product of the third-stage grinding mill is fed back to the recovery circuit.

A twelfth embodiment can include the multiple-stage grinding circuit of the eleventh embodiment, wherein the second separator comprises a different geometry to the first separator.

A thirteenth embodiment can include the multiple-stage grinding circuit of the eleventh or twelfth embodiments, wherein the target mineral size for the second-stage grinding mill is larger than the target mineral size for the third-stage grinding mill.

A fourteenth embodiment can include the multiple-stage grinding circuit of any of the eleventh through thirteenth embodiments, wherein the second-stage grinding mill comprises a ball mill.

A fifteenth embodiment can include the multiple-stage grinding circuit of any of the eleventh through fourteenth embodiments, wherein the third-stage grinding mill comprises a stirred mill.

In a sixteenth embodiment, a method for retrofitting a multiple-stage grinding circuit may comprise increasing the target mineral size for a second-stage grinding mill in a grinding circuit to produce a coarser product; separating, by a first separator, the product of the second-stage grinding mill into a first coarse stream and a first fines stream; feeding the first fines stream to a recovery circuit; adding a second separator to the grinding circuit configured to separate rejected material from the recovery circuit into a second coarse stream and a second fines stream; adding a third-stage grinding mill to the grinding circuit configured to receive the second coarse stream from the second separator; and feeding the product of the third-stage grinding mill to the recovery circuit.

A seventeenth embodiment can include the oxygen sensor of the sixteenth embodiment, wherein the method is completed without shutdown of the existing equipment, including the second-stage grinding mill, the first separator, and the recovery circuit.

An eighteenth embodiment can include the method of the sixteenth or seventeenth embodiments, further comprising recovering, via the recovery circuit, the same material from the second stage of grinding and the third stage of grinding to produce a marketable product.

A nineteenth embodiment can include the method of any of the sixteenth through eighteenth embodiments, wherein the target mineral size for the second stage of grinding is larger than the target mineral size for the third stage of grinding.

A twentieth embodiment can include the method of any of the sixteenth through eighteenth embodiments, wherein the target mineral size for the third stage of grinding is the same as the original target mineral size for the second stage of grinding (that was increased).

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as "comprises," "includes," and "having" should be understood to provide support for narrower terms such as "consisting of," "consisting essentially of," and "comprised substantially of." Use of the terms "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A method for multiple-stage grinding, the method comprising:

providing a feed of crushed ore material;

grinding the crushed ore material in a first stage of grinding in a first grinder;

separating, in a first stage of separating, the crushed ore material by size into a first fines stream and a first coarse stream;

grinding the first coarse stream in a second stage of grinding in a second grinder that is different from the first grinder;

feeding the product of the second stage of grinding back to the step of separating;

feeding the first fines stream from the step of separating to a recovery circuit;

recovering, by the recovery circuit, a target mineral size of the crushed ore material to produce a marketable product;

producing a rejected stream from the recovery circuit of crushed ore material that does not meet the target mineral size;

separating, in a second stage of separating, the rejected stream from the recovery circuit into a second fines stream and a second coarse stream;

grinding the second coarse stream in a third stage of grinding; and feeding the product of the third stage of grinding back to the recovery circuit.

2. The method of claim 1, further comprising diluting the rejected stream from the recovery circuit with water.

3. The method of claim 2, further comprising removing water from the crushed ore material from the recovery circuit using one or more dewatering cyclones.

4. The method of claim 3, wherein the second stage of separating is completed by the one or more dewatering cyclones.

5. The method of claim 1, further comprising recovering the same material from the second stage of grinding, via the recovery circuit, and the third stage of grinding, via the recovery circuit, to produce the marketable product.

6. The method of claim 1, wherein the target mineral size for the second stage of grinding is larger than the target mineral size for the third stage of grinding.

7. The method of claim 6, wherein grinding the coarse stream in a second stage of grinding comprises grinding to a target mineral size of approximately 80% passing 300 microns.

8. The method of claim 6, wherein grinding the coarse stream in a third stage of grinding comprises grinding to a target mineral size of approximately 80% passing 100 microns.

9. The method of claim 1, wherein the second stage of grinding is completed using a ball mill.

10. The method of claim 1, wherein the third stage of grinding is completed using a stirred mill.

11. A multiple-stage grinding process comprising:

a first-stage grinding mill configured to receive crushed ore material, and complete a first stage of grinding the crushed ore material;

a first separator configured to separate the crushed ore material into a first fines stream and a first coarse stream;

a second-stage grinding mill that is different from the first-stage grinding mill, wherein the second-stage grinding mill is configured to receive the first coarse stream, and complete a second stage of grinding the crushed ore material;

a recovery circuit configured to receive the first fines stream, configured to recover a target mineral size of the crushed ore material, producing a marketable product, and to produce a rejected stream of material that does not meet the target mineral size;

a second separator configured to receive the rejected stream from the recovery circuit and separate the crushed ore material into a second fines stream and a second coarse stream; and a third-stage grinding mill configured to receive the second coarse stream, and complete a third stage of grinding the crushed ore material, wherein the product of the third-stage grinding mill is fed back to the recovery circuit.

12. The multiple-stage grinding process of claim 11, wherein the second separator comprises a different geometry to the first separator.

13. The multiple-stage grinding process of claim 11, wherein the target mineral size for the second-stage grinding mill is larger than the target mineral size for the third-stage grinding mill.

14. The multiple-stage grinding process of claim 11, wherein the second-stage grinding mill comprises a ball mill.

15. The multiple-stage grinding process of claim 11, wherein the third-stage grinding mill comprises a stirred mill.

* * * * *